US005407526A

United States Patent [19]

Danielson et al.

[11] Patent Number: 5,407,526

[45] Date of Patent: Apr. 18, 1995

[54] CHEMICAL MECHANICAL POLISHING SLURRY DELIVERY AND MIXING SYSTEM

[75] Inventors: Donald D. Danielson, Aloha; Allen D. Feller; Kenneth C. Cadien, both of Portland, all of Oreg.

[73] Assignee: Intel Corporation, Santa Clara, Calif.

[21] Appl. No.: 85,971

[22] Filed: Jun. 30, 1993

[51] Int. Cl.[6] ..... H02N 21/304; H01L 21/306

[52] U.S. Cl. ..... 156/636; 156/626; 156/645

[58] Field of Search ..... 156/626, 636, 645

[56] References Cited

U.S. PATENT DOCUMENTS

| | | | |
|---|---|---|---|
| 4,879,258 | 11/1989 | Fisher | 437/225 |
| 4,944,836 | 7/1990 | Beyer et al. | 156/645 |
| 4,954,142 | 9/1990 | Carr et al. | 51/309 |

OTHER PUBLICATIONS

F. B. Kaufman, D. B. Thompson, R. E. Broadie, M. A. Jaso, W. L. Guthrie, D. J. Pearson, & M. B. Small, "Chemical-Mechanical Polishing For Fabricating Patterned W Metal Features As Chip Interconnects", IBM Research Division, Thomas J. Watson Research Center, New York & IBM General Tech. Div., New York, J. Electrochem. Soc., vol. 138, No. 11, Nov. 1991 pp. 3460–3465.

William J. Patrick, William L. Guthrie, Charles L. Standley, & Paul M. Schiable, "Application Of Chemical Mechanical Polishing To The Fabrication Of VLSI Circuit Interconnections", IBM General Technology Division, New York, J. Electrochem Soc., vol. 138, No. 6, Jun. 1991, pp. 1778–1784.

T. A. Shankoff and E. A. Chandross, "High Resolution Tungsten Patterning Using Buffered, Mildly Basic Etching Solutions", Bell Laboratories, New Jersey, J. Electrochem Soc., vol. 122, No. 2, Feb. 1975, pp. 294–298.

*Primary Examiner*—R. Bruce Breneman
*Assistant Examiner*—Felisa Garrett
*Attorney, Agent, or Firm*—Blakely, Sokoloff, Taylor & Zafman

[57] ABSTRACT

A method and apparatus for mixing and delivering a slurry polishing and etching a semiconductor device is described wherein the slurry chemicals are mixed at the point of use. An abrasive solution and a oxidant solution are stored in separate storage containers. When the polish/etch is to begin, each of the chemicals are pumped into a mixing chamber where they are mixed so as to form a slurry. The slurry is then immediately used to polish/etch a semiconductor device. Other chemicals may be added to the slurry during the polish/etch process so as to change the polish and/or the etch rate during the polish/etch process.

20 Claims, 5 Drawing Sheets

CHEMICAL MECHANICAL POLISHING SLURRY DELIVERY AND MIXING SYSTEM

BACKGROUND OF THE INVENTION

Chemical mechanical polishing (CMP) techniques are used in the semiconductor industry to remove metals from semiconductor surfaces. One common use of these techniques is to remove that portion of a layer of tungsten or other metal which overlies an interlayer dielectric glass such as phosphosilicate glass (PSG), borosilicate glass (BSG), borophosphocilicate glass (BPSG) or silicon dioxide ($SiO_2$), so as to form plugs within the layer of dielectric. First, openings are formed within the dielectric layer. A layer of metal is then deposited so as to fill the openings and to form an overlying layer of metallization. The metal layer is then polished until the layer of metallization which overlies the dielectric is removed. The portion of the metal layer which fills the vias remains, forming metal fill areas. Fill areas are often referred to as being either "vias" or "plugs" depending on the material to be contacted. However, in the present application, all fill areas will be referred to as "plugs" irrespective the material to be contacted.

Prior art processes for removing the overlying layer of metallization have included standard dry etches. Prior art dry etch steps typically leave etch residue, metal particles, or metal islands remaining on the ILD glass surface. They can also leave a mottled or pitted glass surface due to the tungsten dry etch chemistry attacking the glass. In addition, dry etches can over-etch plugs so as to form excessive plug recess, concave non uniformly etched plugs, and etch-out of the metal/-glass side wall interface.

In order to overcome these disadvantages manufactures have used chemical mechanical polishing (CMP) to remove the overlying layer of metallization. Prior art techniques for chemical mechanical polishing have involved the use of premixed bulk slurry chemicals. The metal polishing bulk slurries formed using these chemicals tend to agglomerate or gel quickly and foul up the slurry delivery plumbing of the polishing apparatus. Consequently, the use of premixed bulk slurry chemicals can often lead to unevenly polished surfaces. Also, the pH levels required to keep the premixed bulk slurries from gelling can alter the metal polishing rate and selectivity to the dielectric such that over-etch of the plug results. Other problems with the use of bulk slurries are the fact that polishing equipment delivery systems may corrode rapidly, dynamic changes of slurry chemistry are not feasible, and the fact that most premixed slurries are not within the limited ranges of slurry mixtures which are effective. This limited range for premixed slurries is primarily due to the delicate balance needed between the chemical stability of slurry and the ability of the slurry to polish metal. What is needed is a process for generating CMP slurry that has a wide pH range, will not gel, and will not form chemical precipitates but will provide the right balance of polishing and etching which creates a smooth, planar glass surface and uniform plug surface while maintaining a high metal removal rate and high selectively between the metal and glass dielectric.

SUMMARY OF THE INVENTION

Described is a method for mechanical polishing which allows for a high metal removal rate, smooth uniform dielectric and plug surfaces and high metal to glass selectivity. A method for chemical delivery and compound mixing of a tungsten Chemical Mechanical Polishing (CMP) slurry is described which provides flexibility in the formulation and use of slurry necessary for high volume manufacturing of plugs used in integrated circuit devices. The chemical components of the slurry are mixed at the actual point of use of the slurry. This allows for the creation of slurries which give superior polish/etch rates and do not over-etch plugs. Additionally, a wide range of chemical conditions may be maintained without slurry gelling. Chemicals which have a long shelf life may be used as oppose to premixed bulk slurry chemicals which may have limited shelf lives. Furthermore, slurries may be formulated which are non corrosive towards aluminum and stainless steel, and which allow for longer polishing pad life. In addition, point of use slurry mixture allows for dynamic slurry changes within a polishing cycle.

The method for CMP slurry delivery and polishing of the present invention uses the synchronized delivery of silica suspension, oxidant and buffer chemicals. An abrasive chemical having a relatively high pH level (approximately 11) and an oxidant chemical having a relatively low pH (3 to 7) are used to create a slurry. In the preferred embodiment silica suspension is used as an abrasive and potassium ferricyanide is used as the oxidizing chemical. As the silica suspension is stable at a pH of 11 and the oxidant is stable at a pH of approximately 3 to 4, no gelling occurs of either component. Each of these two separate components are dynamically mixed at the point of use so as to create a mixture having a pH between 3 and 7. This pH level allows for optimum polish/etch results. The combination of point of use mixing and fluid velocity generated by the polishing device during polishing keeps the slurry from setting up or gelling. Thus, a balanced polish/etch reaction can be obtained which has little if any oxidation reaction over-etch of the plugs.

The preferred embodiment of the present invention forms a slurry having a pH level of between 3 and 7. This level would not be practical in a prior art premixed bulk slurry polishing system as the mixture would either gel, or the suspended silica would fall out of suspension. Thus, an entirely new range of chemical slurries may be created by the present invention.

The over-etch problems of prior art methods may be overcome by the present invention. Point of use mixing allows for plug recesses (for tungsten plugs) lower than 500Å. This may be compared to dry etch prior art plug recesses of 2,000 to 3,000Å. Because of the relatively slower and more controlled dielectric polish rate of the present invention, improved dielectric surface planarity may be achieved. Whereas the dielectric planarity using prior art premixed bulk chemicals yields planarity uniformity of 15% or more, the methods of the present invention allow for planarity of uniformity 7% or less. The surface roughness is also decreased because of the slower, more controlled glass polish rates of the method of the present invention. Whereas prior art methods generally give a surface roughness in the order of plus or minus several hundred A root means square (RMS), the methods of the present invention can yield RMS roughness levels of plus or minus 2Å.

As previously discussed, the method the present invention allows for the creation of a slurry having a lower pH which is less reactive chemically than prior art slurries. The slurry of the present invention gives a rapid polish/removal of the portion of the metal layer overlying the dielectric layer and a slow polish/etch once the polish pads reaches dielectric layer. The slurry of the present invention causes a passive oxidized surface species of the metal layer to form. This passive oxidized surface does not allow chemical etching to progress until such time as the polishing pad removes the passive oxidized surface. Since the passive oxidized surface prevents further etch, over etch of plugs is prevented once the polish/etch reaches the dielectric layer.

DESCRIPTION OF THE DRAWINGS

The present invention will now be described with reference to a preferred embodiment in which.

DESCRIPTION OF THE PREFERRED EMBODIMENT

In the following descriptions, numerous specific details such as dimensions, specific chemical components and delivery methods, etc. are described in order to provide a thorough understanding of the present invention. It will be obvious, however, to one skilled in the art that the present invention can be practiced without these specific details. In other instances, well known method steps have not been described in detail in order not to unnecessarily obscure the present invention.

Figure 1:
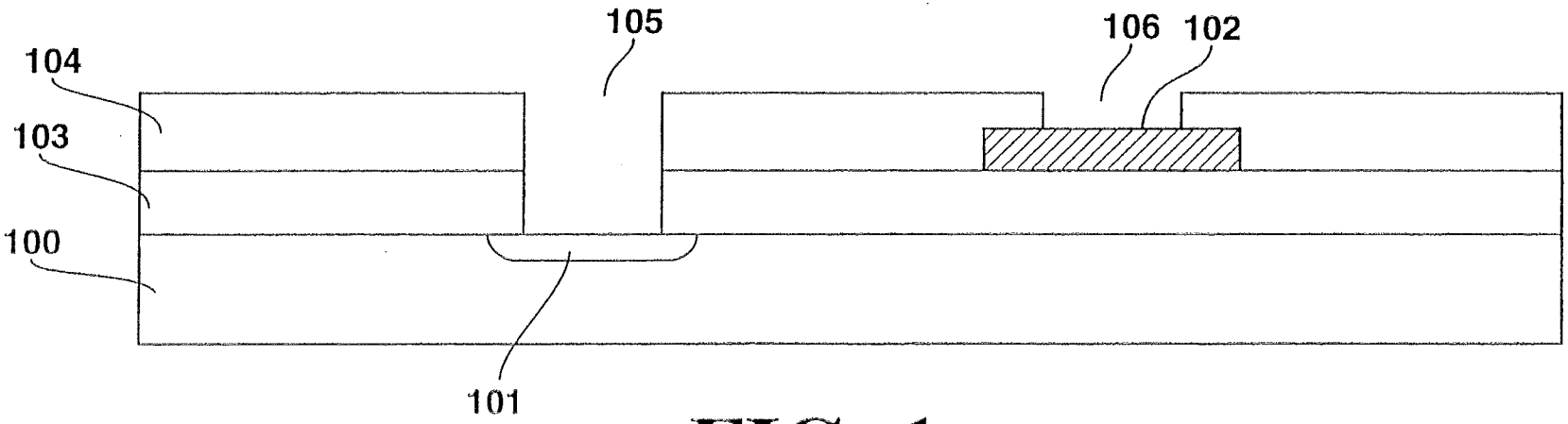
FIG. 1 illustrates a cross section of a portion of a wafer surface having an dielectric layer in which a plurality of openings have been formed.

FIG. 1 illustrates a cross section of a portion of a semiconductor wafer 100 upon which a diffusion region 101 has been formed. This diffusion region may be an N or P doped region and is formed by methods well known to those in the art. Dielectric S layers are then formed over the semiconductor surface. Dielectric region 103 is shown to overlie the wafer surface. Conductor 102 is then formed by depositing and patterning a layer of conductive material over the dielectric layer 103. The conductor 102 is usually formed from a metal which may be a combination of aluminum, titanium, and titanium nitride. Dielectric layer 104 is shown as overlying the conductor 102. This layer may be Polysilicate Glass (PSG), Silicon Dioxide or any number of other dielectric materials. Openings 105 and 106 are then etched so as to expose the diffusion region 101 and the conductor 102. Though opening 105 is shown to directly contact the diffusion region 101 it is well known in the art to form other layers or structures over the diffusion region. The contact may be to these overlying layers. For example, a silicide layer is typically formed over the diffusion region.

Figure 2:
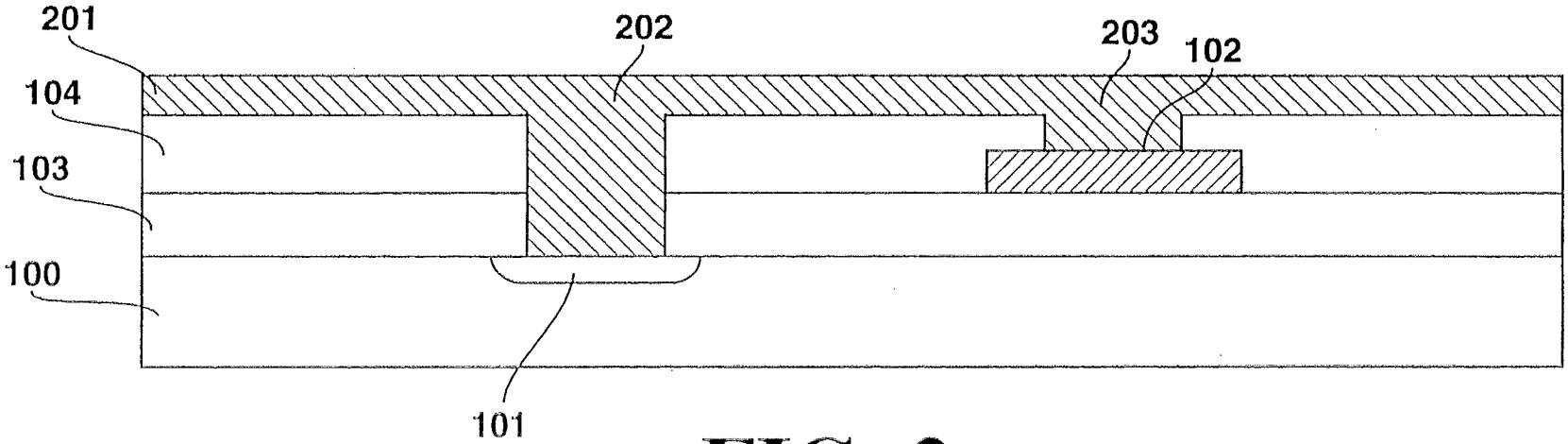
FIG. 2 illustrates the structure of FIG. 1 upon which a layer of metal has been deposited.

FIG. 2 illustrates the structure shown in FIG. 1 after a conductive layer 201 has been deposited. This layer is typically formed by depositing a metal layer over the wafer surface. In the preferred embodiment of the present invention this metal layer is comprised of tungsten. This metal layer will fill openings 105 and 106 so as to form fill areas 202 and 203, and so as to overlie the top surface of dielectric layer 104.

Figure 3:
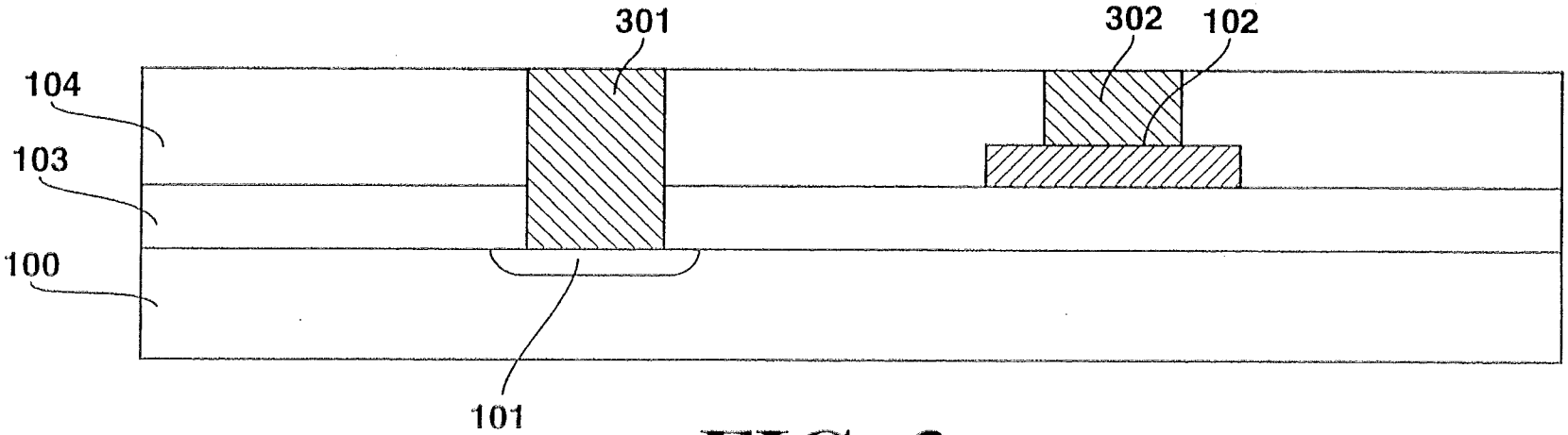
FIG. 3 illustrates the structure of FIG. 2 after chemical mechanical polishing.

FIG. 3 shows the semiconductor wafer of FIG. 2 after the polish/etch process has removed that portion of the metal layer 201 which overlies dielectric layer 104 and fill areas 202 and 203 shown in FIG. 2. The polish/etch process has formed plug 301 and plug 302. Note that here is no over-etch, leaving the top surfaces of the plugs level with, or nearly level with the top surface of dielectric layer 104. The top surface which is formed has a high surface planarity. In addition, the surface roughness is decreased over that of prior art surfaces.

Figure 4:
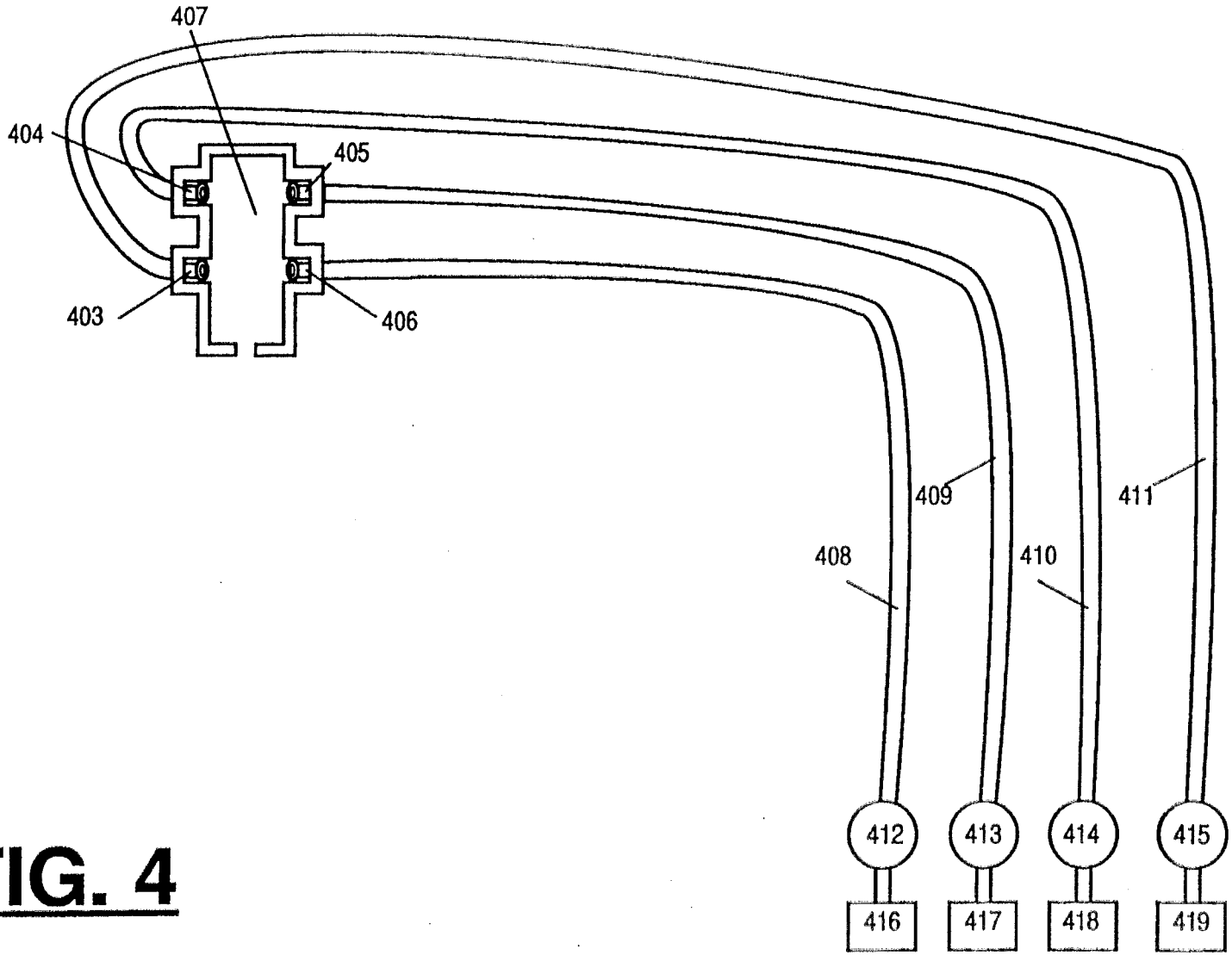
FIG. 4 illustrates the CMP slurry delivery and mixing apparatus.

FIG. 4 illustrates an apparatus for slurry delivery and mixture which incorporates the use of slurry pumps 412, 413, 414, and 415. These pumps are preferably peristaltic pumps which use a single motor so that the pumps are in phase. A Cabot brand glass polishing slurry diluted down to 3–12 percent silica may be used as the slurry abrasive. This slurry is shown to be stored in chemical storage container 416. The polishing slurry contains colloidal silicon dioxide ($SiO_2$) at a pH of approximately 10 to 11. This colloidal silicon dioxide is suspended in water by the use of suspension agents which are included in the Cabot brand silica. The abrasive solution may be formed by diluting Cabot brand silica (SEMI-SPERSE Grade 25) to a 20% by weight mixture with water.

Chemical storage container 417 is shown to contain the oxidation chemical and pH setting buffers. The oxidation chemical is preferably potassium ferricyanide ($K_3Fe[CN]_6$) and the buffer is acetate. Though any number of chemicals and proportions of chemicals may be employed, the preferred embodiment uses 0.20 molar potassium ferricyanide as an oxidant and mixes an acetate buffer in with the oxidant. In the preferred embodiment $0.5\times10^{-5}$ molar acetate and $8\times10^{-5}$ molar acetic acid comprise the buffer. Chemical storage container 418 and 419 may contain any of a number of ingredients. Furthermore, any number of additional storage containers and chemicals could be used. One with skill in the art would realize that the pH setting buffer could also be contained in chemical storage containers 418 and 419 and could be separately mixed, as could any number of other required chemicals. For illustration purposes, chemical storage containers 418 and 419 are shown to contain chemical reagents which speed up or slow down the reactions and which may improve polish uniformity. Chemical storage container 418 is shown to contain an acid. This acid may be selectively added at proper points in the CMP procedure so as to slow down the oxidation reaction. In the preferred embodiment, a solution having 2.0 molar acetic acid is used to slow down the reaction. This can be particularly useful when the endpoint of the etch process is achieved so as to assure that there is no over-etch of top surfaces of plugs 301 and 302. Storage container 419 is shown to contain a base chemical. The base chemical in chemical storage container 419 may be selectively added to the mixture to speed up the oxidation reaction or improve polish uniformity. In the preferred embodiment ethylenediamine is used as a base and a typical base solution contain $1.0\times10^{-4}$ molar ethylenediamine.

Primary pumps 412 and 413 deliver a continuous flow of chemical through hoses 408 and 409 and through nozzles 405 and 406 into the mixing chamber 407. These pumps are preferably synchronized so as to deliver a uniform volume of chemicals into the mixing chamber 407. Selectively powered pumps 414 and 415 are shown to provide for selective pumping from chemical storage containers 414 and 415 through hoses 410 and 411 and through nozzles 403 and 404 into the mixing chamber 407. Though pumps 414 and 415 are preferably synchronized with primary pumps 412 and 413, they are only engaged only when a particular chemical is required during the CMP process. The exact chemicals and components used are merely for illustration purposes, one with skill in the art would realize that any number of chemicals could be used. For example, the present invention could be practiced by the use of only two chemical storage containers. In that situation one storage container would contain suspended abrasive solution while the other would contain a combination of oxidation reagents and a pH setting buffer. Though accelerants and deccelerants are preferred, they are not required in order to practice the present invention.

Because of the agitation created at the mixture chamber 407 and the agitation at the interface between the wafer surface and the polishing pad, the slurry does not have an opportunity to gel or separate.

Figure 5:
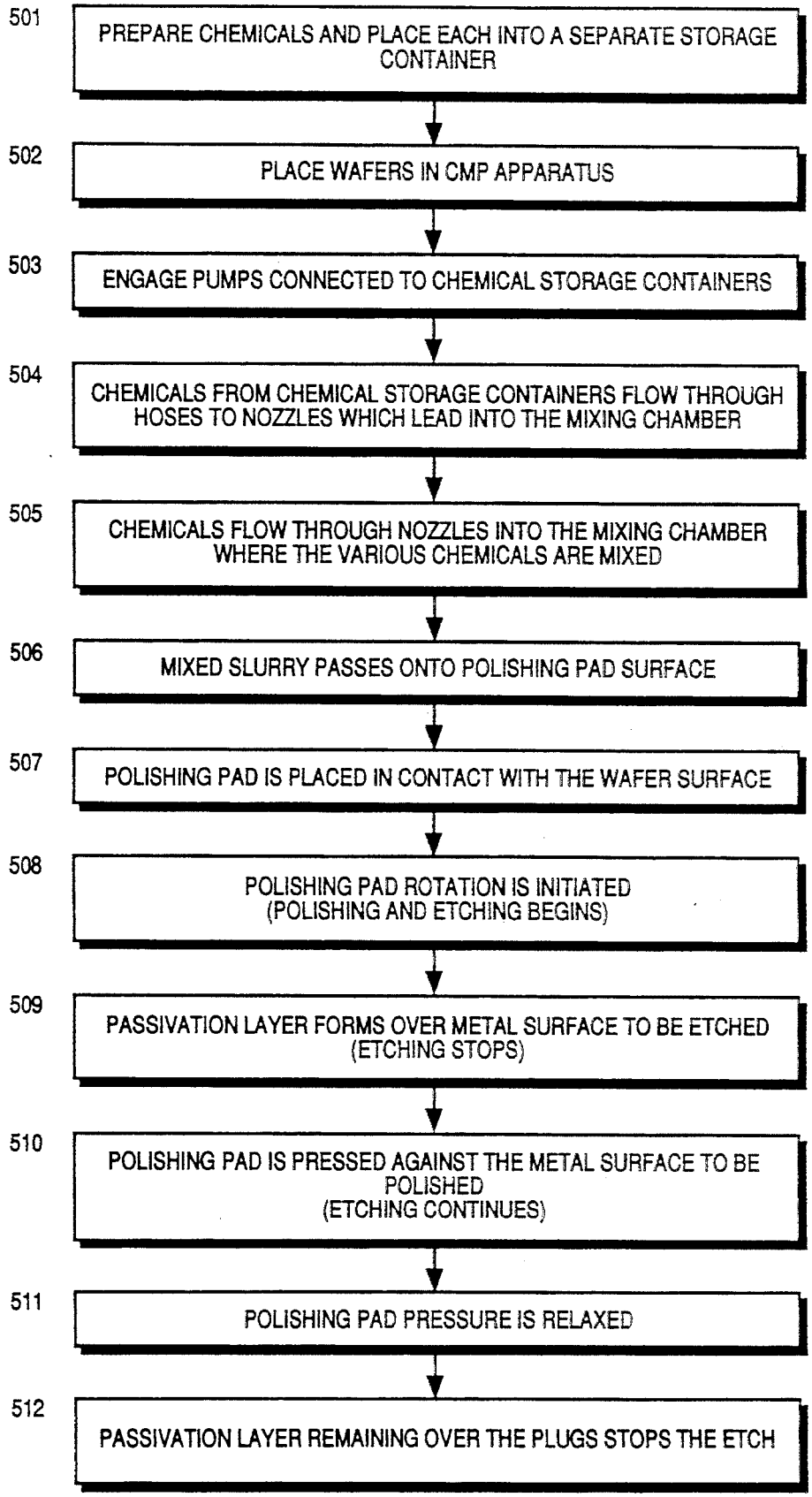
FIG. 5 illustrates the steps of the CMP polish/etch process.

FIG. 5 illustrates the steps of the preferred embodiment. First, as illustrated by block 501 abrasive chemicals are prepared and placed into one of the chemical storage containers and oxidant chemicals are prepared and placed into a second chemical storage container. If additional chemicals are to be used, they are also prepared and placed into chemical storage containers. Next, as illustrated by block 502, the wafers to be polished/etched are placed in the CMP apparatus. There are any number of polishing systems known in the art for performing CMP polishing. Typically, however, the slurry is dispensed onto a flat polishing surface known as a polishing pad. The wafer is placed onto the polishing pad and the wafer is both rotated and moved across the polish pad surface.

The pumps connected to the chemical storage container containing the abrasive chemicals and the oxidant chemicals are then engaged as shown by block 503. As shown by block 504 the pumps force the chemicals through hoses connected to the pumps so as to force the chemicals to nozzles leading into the mixing chamber. The chemicals flow through the nozzles and into the mixing chamber as shown by block 505 where the various chemicals are mixed so as to form a mixed slurry. The mixed slurry is delivered immediately to the polishing surface of the polishing pad as shown by block 506. The wafer surface is then placed in contact with the polishing pad as shown by block 507. The rotation of the polishing pad is then initiated as illustrated by block 508. As the metal surface is polished, a passive film will form over the surface of the metal layer being polished as shown by block 509. This film constitutes a passivation layer which stops the etching from proceeding. The etch of the surface of the layer being polished can only proceed after the removal of the passivation layer. Next, as shown by block 510, the constant pressure of the polishing pad against the metal surface to be polished removes the passivation layer. Polishing and etching will then continue as long as the polishing action keeps the layer of passivation from remaining over the meal surface. Thus, at the point of contact between the polishing pad and the surface to be polished, the oxidation surface products are continually disturbed such that the etching oxidation reaction continues to occur. Once the polish reaches the surface of the dielectric layer the rate of metal loss is reduced compared to the rate of loss of the dielectric due to the selectivity of the polish and the inability of the polishing pad to contact the passivated plug surface. CMP will continue until the desired polishing endpoint is reached. As shown by block 511, the application of pressure is then either relaxed or discontinued. As shown by block 512, the etch then stops due to the passivation layer remaining over each of the plugs. Though the process is discussed as a series of discrete steps, the polish process is a dynamic and continuous process. Thus, the polishing and etching process is initiated when the polishing pad contacts the wafer surface, and continues until the polishing pad pressure is relaxed or discontinued when an endpoint is reached.

The point of use mixing allows for control of the slurry throughout the CMP process. For example, base and acid may be selectively added as needed throughout the CMP process to control the etch rate. In addition, as the endpoint of the etch is reached a slug of acid may be added to slow down or stop the etch reaction.

What is claimed is:

1. A method for slurry delivery and mixing for the chemical mechanical polishing of a semiconductor device having a top surface by a polishing pad having a polishing surface comprising the steps of:

injecting an abrasive solution into a mixing area;

injecting an oxidant solution into a mixing area such that said oxidant solution is mixed with said abrasive solution so as to forma slurry; and depositing said slurry such that said slurry contacts said polishing surface and such that said slurry contacts said top surface of said semiconductor device; and, chemical mechanical polishing said semiconductor device.

2. The method of claim 1 wherein said top surface of said semiconductor device comprises tungsten and wherein a layer of insoluble oxide is formed over said top surface of said semiconductor device, said layer of insoluble oxide comprising tungsten oxide.

3. The method of claim 2 further comprising the step of selectively adding a base chemical to said slurry during said step of chemical mechanical polishing said substrate for accelerating the etch rate of said slurry.

4. The method of claim 3 wherein said base chemical comprises one of the group consisting of ethylenediamine, potassium hydroxide, and sodium hydroxide.

5. The method as described in claim 3 wherein at least a portion of said steps of injecting, and mixing said oxidant and said abrasive solutions, and said step of depositing said slurry occur during said step of chemical mechanical polishing of said semiconductor device.

6. The method of claim 2 further comprising the step of selectively adding an acid to said slurry during said step of chemical mechanical polishing said substrate for decelerating the etch rate of said slurry.

7. The method of claim 6 wherein said acid comprises acetic acid.

8. The method as described in claim 2 wherein at least a portion of said steps of injecting, and mixing said oxidant and said abrasive solutions, and said step of depositing said slurry occur during said step of chemical mechanical polishing of said semiconductor device.

9. The method of claim 1 wherein said oxidant solution comprises potassium ferricyanide.

10. The method of claim 1 wherein said abrasive solution comprises silica.

11. The method of claim 1 further comprising the step of selectively adding a base chemical to said slurry during said step of chemical mechanical polishing said substrate for accelerating the etch rate of said slurry.

12. The method of claim 11 further comprising the step of selectively adding an acid to said slurry during said step of chemical mechanical polishing said substrate for decelerating the etch rate of said slurry.

13. The method of claim 12 wherein said base chemical comprises one of the group consisting of ethylenediamine, potassium hydroxide, and sodium hydroxide and said acid comprises acetic acid.

14. The method as described in claim 13 wherein at least a portion of said steps of injecting, and mixing said oxidant and said abrasive solutions, and said step of depositing said slurry occur during said step of chemical mechanical polishing of said semiconductor device.

15. The method of claim 11 wherein said base chemical comprises one of the group consisting of ethylenediamine, potassium hydroxide, and sodium hydroxide.

16. The method as described in claim 11 wherein at least a portion of said steps of injecting, and mixing said oxidant and said abrasive solutions, and said step of depositing said slurry occur during said step of chemical mechanical polishing of said semiconductor device.

17. The method of claim 1 further comprising the step of selectively adding an acid to said slurry during said step of chemical mechanical polishing said substrate for decelerating the etch rate of said slurry.

18. The method of claim 17 wherein said acid comprises acetic acid.

19. The method as described in claim 17 wherein at least a portion of said steps of injecting, and mixing said oxidant and said abrasive solutions, and said step of depositing said slurry occur during said step of chemical mechanic, polishing of said semiconductor device.

20. The method as described in claim 1 wherein at least a portion of said steps of injecting, and mixing said oxidant and said abrasive solutions, and said step of depositing said slurry occur during said step of chemical mechanical polishing of said semiconductor device.

* * * * *

UNITED STATES PATENT AND TRADEMARK OFFICE

CERTIFICATE OF CORRECTION

PATENT NO. : 5,407,526

DATED : April 18, 1995

INVENTOR(S) : Danielson et al.

It is certified that error appears in the above-identified patent and that said Letters Patent is hereby corrected as shown below:

On the title page, in the second line of the Abstract, item [57], insert --for-- between "slurry" and "polishing".

In column 2, at line 63, delete "A" and substitute --Å--.

In column 3, at line 43, delete "S".

In column 5, at line 32, delete "fiat" and substitute --flat--.

In column 8, at line 14, delete "mechanic," and substitute --mechanical--.

Signed and Sealed this

Twenty-second Day of October, 1996

*Attest:*

Bruce Lehman

BRUCE LEHMAN

*Attesting Officer*

*Commissioner of Patents and Trademarks*